United States Patent [19]

Kato

[11] Patent Number: 4,927,333

[45] Date of Patent: May 22, 1990

[54] FLUID PUMP

[75] Inventor: Kichiro Kato, Susono, Japan

[73] Assignee: Toyota Jidosha Kabushiki Kaisha, Japan

[21] Appl. No.: 297,969

[22] Filed: Jan. 17, 1989

[30] Foreign Application Priority Data

Jan. 22, 1988 [JP] Japan ..... 63-10881
Jun. 20, 1988 [JP] Japan ..... 63-150014

[51] Int. Cl.[5] ..... F04B 35/00

[52] U.S. Cl. ..... 417/316; 417/319; 417/362; 123/561

[58] Field of Search ..... 417/316, 319, 362, 423.6; 123/561; 418/69

[56] References Cited

U.S. PATENT DOCUMENTS 1,954,436 4/1934 Waseige ..... 123/561 X
2,640,428 6/1953 Houghton ..... 417/410
2,902,205 9/1959 Parker ..... 417/319
2,940,661 6/1960 Lorenz ..... 417/351 X

FOREIGN PATENT DOCUMENTS 3706588 8/1988 Fed. Rep. of Germany ..... 417/362
61-137851 8/1986 Japan .
62-61940 4/1987 Japan .
2207190 1/1989 United Kingdom ..... 417/362

*Primary Examiner*—Leonard E. Smith
*Assistant Examiner*—Eugene L. Szczecina
*Attorney, Agent, or Firm*—Kenyon & Kenyon

[57] ABSTRACT

A fluid pump having a housing, a pair of rotors, a pair of rotor shafts for supporting the rotors in the housing, identical mating gears provided on the rotor shafts, and rotary drive for rotating the rotor shafts to rotate the rotors, and comprising a one-way clutch operatively connecting the rotary drive to the rotor shaft, a multiple-disc clutch operatively connecting the rotary drive to the other rotor shaft, and coils for generating a magnetic force by which the multiple-disc clutch is activated. When the multiple-disc clutch is not activated, rotation of the rotary drive is transmitted to the rotor shaft through the one-way clutch, and when the multiple-disc clutch is activated by the coils, rotation of the rotary drive is transmitted to the other rotory shaft through the multiple-disc clutch. By activating or inactivating of the multiple-disc clutch, it is possible to change the drive-driven relationship between the rotor shafts, so that a nonuniform wear of the mating gears is eliminated.

8 Claims, 7 Drawing Sheets

FLUID PUMP

BACKGROUND OF THE INVENTION

1. Field of the Invention

The present invention relates to a fluid pump such as a mechanically driven supercharger in an internal combustion engine.

2. Description of the Related Art

Known in the related art, e.g., Japanese Unexamined Utility Model Publication No. 62-61940, is a fluid pump having a rotary drive and a pair of rotors which are synchronously rotated by the rotary drive. This fluid pump comprises, as shown in FIG. 6, a drive shaft 40 which forms a part of the rotary drive and is driven by a drive source (not shown) such as a motor or a crankshaft of an engine, a pair of rotor shafts 41 and 42 supporting rotors 43 and 44, and identical mating gears 45 and 46 fixed on each end of the rotor shafts 41 and 42 and in mesh with each other. The rotor shaft 41 is rotated by the drive shaft 40 through the meshing of a gear 47 fixed thereto and another gear 48 fixed to the rotor shaft 41. In the above construction, since the drive-driven relationship between the rotor shafts 41 and 42 is unchangeable, then as shown in FIG. 7, only one tooth surface 49*a* of each tooth 49 of the gear 45 fixed on the rotor shaft 41 comes into contact with one tooth surface 50*a* of each tooth 50 of the gear 46 fixed on the rotor shaft 42. Additionally, loads in the direction of arrows F are imparted to bearings 51 and 52 supporting the rotor shafts 41 and 42 respectively, and therefore, both the gears 45 and 46, and the bearings 51 and 52 are worn nonuniformly, and thus the fluid pump has a poor durability.

SUMMARY OF THE INVENTION

An object of the present invention is to provide a fluid pump having an excellent durability.

According to the present invention, there is provided a fluid pump comprising: a housing having an inlet and an outlet; a pair of rotors rotatably arranged in the housing and engaged with each other; a pair of rotor shafts for supporting the rotors, respectively, and rotatably arranged in the housing; identical mating gears provided on the rotor shafts, respectively, and in mesh with each other; a rotary drive for driving either of the rotor shafts to rotate the rotors; a first clutch means provided between the rotary drive and one of the rotor shafts to transmit the rotation of the rotary drive to the rotor shaft; a second clutch means provided between the rotary drive and the other rotor shaft to transmit the rotation of the rotary drive to the other rotor shaft, when activated; and a clutch operating means which selectively operates either the first or the second clutch means to thereby change the drive-driven relationship between the rotor shafts.

DESCRIPTION OF THE PREFERRED EMBODIMENTS

Figure 1:
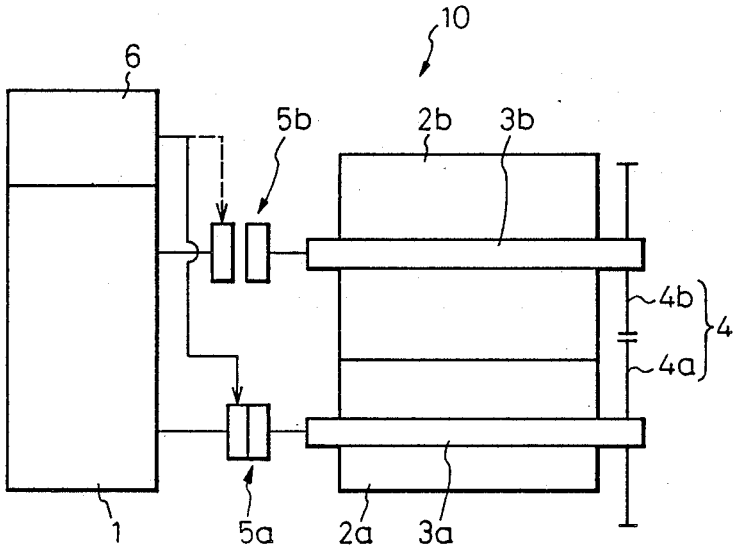
FIG. 1 is a diagram showing the concept of the present invention.

FIG. 1 is a diagram of a fluid pump showing the concepts of the present invention.

In FIG. 1, reference numeral 1 denotes a rotary drive, 2*a* and 2*b* a pair of rotors, 3*a* and 3*b* two rotor shafts, 4(4*a*, 4*b*) identical mating gears, 5*a*, a first clutch means, 5*b* a second clutch means, and 6 a clutch operating means.

In the condition shown in FIG. 1 the clutch operating means 6 has activated the first clutch means 5*a* so that the rotary drive 1 is connected to the rotor shaft 3*a*. In this case, a drive-driven relationship exists between two rotor shafts 3*a* and 3*b*, i.e., the rotor shaft 3*a* is the drive shaft and the rotor shaft 3*b* is the driven shaft.

On the other hand, as shown by a dotted line, if the clutch operating means 6 activates the second clutch means 5*b* so that the rotary drive 1 is connected to the rotor shaft 3*b* the relationship between the rotor shafts 3*a* and 3*b* that in which the rotor shaft 3*b* is the drive shaft and the rotor shaft 3*a* is the driven shaft. Namely, the drive-driven relationship between the rotor shafts 3*a* and 3*b* can be changed providing the first and second clutch means 5*a* and 5*b* between the rotary drive 1 and the rotor shafts 3*a* and 3*b*, respectively, and activating the clutch means 5*a* are 5*b* by the clutch operating means 6.

Figure 2:
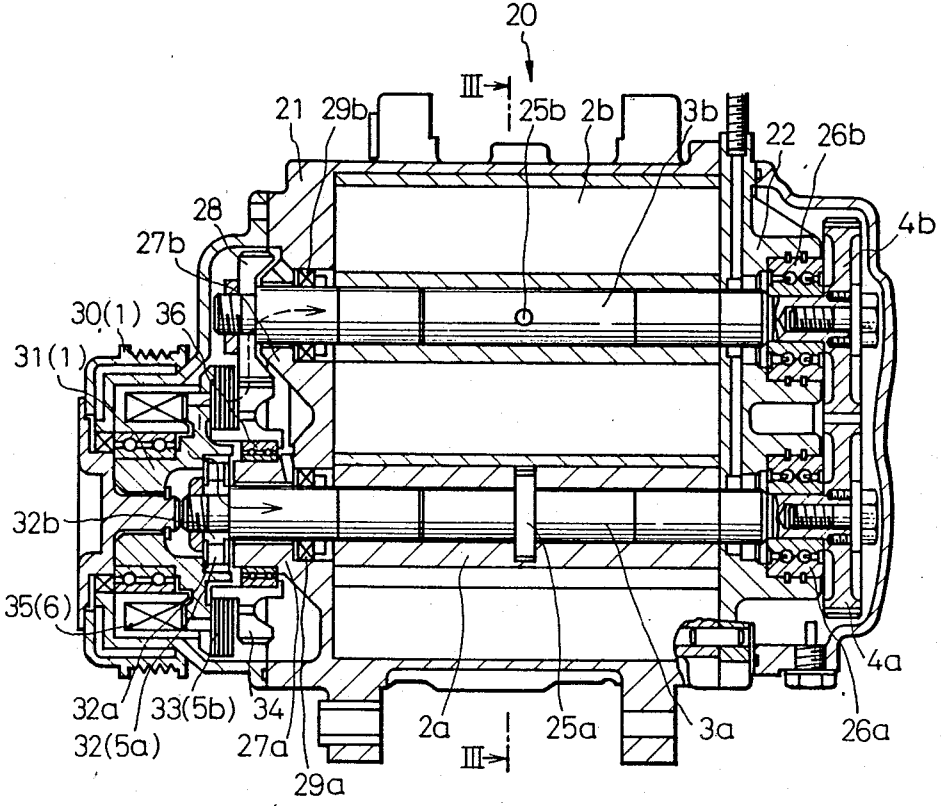
FIG. 2 is a sectional view of a first embodiment of a mechanically driven supercharger according to the present invention.
Figure 3:
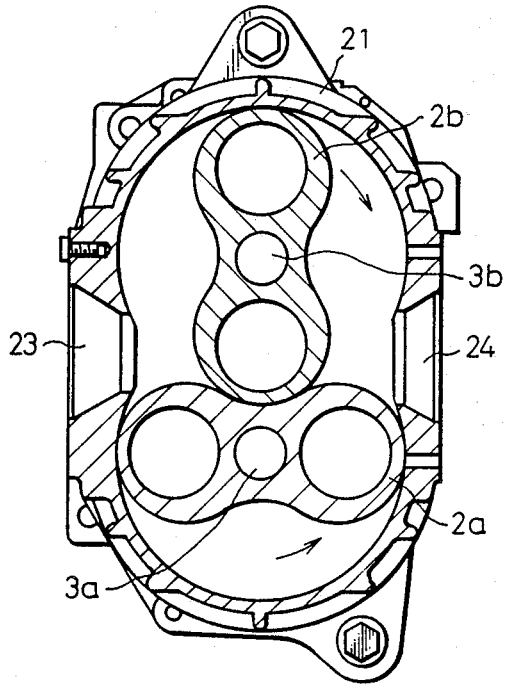
FIG. 3 is a cross sectional view taken along the line III—III of FIG. 2.

FIGS. 2 and 3 show a mechanically driven supercharger able to be driven by a crankshaft of an internal combustion engine, and which embodies the above-mentioned concepts of the invention. In FIG. 2, elements similar to those of FIG. 1 are indicated by the same reference numerals, but elements corresponding to those of FIG. 1 are indicated by new reference numerals and parenthesized corresponding reference numerals of FIG. 1.

In this embodiment, a mechanically driven supercharger, generally designated by reference numeral 20, comprises a housing assembly composed of housing parts 21 and 22, wherein the housing part 21 is provided with an inlet and an outlet (not shown in FIG. 1) through which intake air is passed, and a pair of rotors 2*a* and 2*b* are rotatably arranged in the housing 20.

As shown in FIG. 3, the rotors 2*a* and 2*b* have lobed cocoon-like configurations in cross section nave and rotate synchronously with each other in the housing 20.

The rotors 2*a* and 2*b* are supported respectively by the rotor shafts 3*a* and 3*b* and are fixed thereto by pins 25*a*, and 25*b*. The rotor shafts 3*a* and 3*b* are provided at one end thereof (right hand in FIG. 2) with identical mating gears 4*a* and 4*b*, which mesh with each other, and the rotor shafts 3*a* and 3*b* are rotatably supported in the housing 20 by ball bearings 26*a* and 26*b*, bearing parts 27*a*, and 27*b*, etc. The other end of the rotor shaft 3*b* passing through the housing 20 (left hand in FIG. 2) is provided with a small sub-gear 28 fixed thereto. Note, reference numerals 29*a* and 29*b* denote oil seals.

Provided in alignment with the rotor shaft 3*a* is a pulley 30 which forms a part of &.he rotary drive 1 of FIG. 1. This pulley 30 is driven by a crankshaft of an engine through the intermediary of a belt (not shown in FIG. 2). Inside the pulley 30 is provided a drive rotor 31, which also forms a part of the rotary drive 1 of FIG. 1, and which is fixed to the pulley 30.

Provided between the drive rotor 31 and one end of the rotor shaft 2*a* and inside the drive rotor 31 is a one-way clutch 32 which corresponds to the first clutch means 5*a*, of FIG. 1 and which transmits the rotation of the drive rotor 31 to the rotor shaft 3*a*. This one-way clutch 32, the construction of which is well known by those skilled in the art, transmits the rotation of the rotary drive 1 to the rotor shaft 2*a* when the drive rotor 31 is rotating in one direction and runs free when the drive rotor 31 is rotating in the opposite direction. The one-way clutch 32 comprises an element 32*a* which cooperates with the drive rotor 31 and an another element 32*b* which cooperates with the rotor shaft 2*a*, and accordingly, if the one-way clutch 32 is in the operative condition, i.e., transmitting rotation, the rotor shaft 3*a* becomes the drive shaft, and conversely, the rotor shaft 3*b* becomes the driven shaft.

Provided between the drive rotor 31 and the rotor shaft 2*b*, and outside of the drive rotor 31, is a multiple-disc clutch 33 which focus a part of the second clutch means 5*b* of FIG. 1 and which transmits the rotation of the drive rotor 31 to the rotor shaft 3*b*. The multiple-disc clutch 33 comprises a number of plates, some of which cooperate with the drive rotor 31, and the others of which cooperated with a large free-gear 34. According to this embodiment, the clutch 33 is activated by a magnetic force generated by coils 35 in the vicinity of the clutch 33. The coils 35 correspond to the clutch operating means 6 of FIG. 1.

The free-gear 34 is rotatably mounted on the cylindrical bearing part 27*a* of the housing 20 through the intermediary of a ball bearing 36, and engages the small sub-gear 28.

The operation of the supercharger 20 is as follows. When the coil 35 is not energized, the rotating force transmitted from the crankshaft to the pulley 30 is transmitted to the rotor shaft 3*a* through the intermediary of the drive rotor 31 ant the one-way clutch 5*a*, as shown by a solid line and arrow in FIG. 2, and this rotating force is finally transmitted to the rotor shaft 3*b* through the mating gears 4*a* and 4*b*. Consequently, in this case, a drive-driven relationship exists between the rotor shafts 3*a* and 3*b* wherein the former is the drive shaft and the later is the driven shaft, and the one-way clutch 5*a* transmits the rotation of the drive rotor 31 to the rotor shaft 3*a*. On the other hand, when the coil 35 is energized, the multiple-disc clutch 33 is made to connect the drive rotor 31 with the free-gear 34 by the magnetic force generated from the coil 35. Therefore, the rotation of the pulley 30 is transmitted to the sub-gear 28 through the intermediary of the drive rotor 31, the clutch 33, and the free-gear 34, and thus the rotor shaft 3*b* is rotated, as shown by a dotted line and arrow in FIG. 2, and then, the rotation of the rotor shaft 3*b*, is finally transmitted to the rotor shaft 3*a* through the mating gears 4*b* and 4*a*. Namely, in this case, a drive-driven relationship exists between the rotor shafts 3*a* and 3*b* wherein the former is the driven shaft and the latter is the drive shaft. When the above relationship is realized, the one-way clutch 5*a*, is in an inoperative, i.e., free-running, condition. Namely in detail, the speed of the element 32*b* is raised due to the gear-ratio of the free-gear 34 and the sub-gear 28, and becomes higher than that of the element 32*a*.

Figure 7:
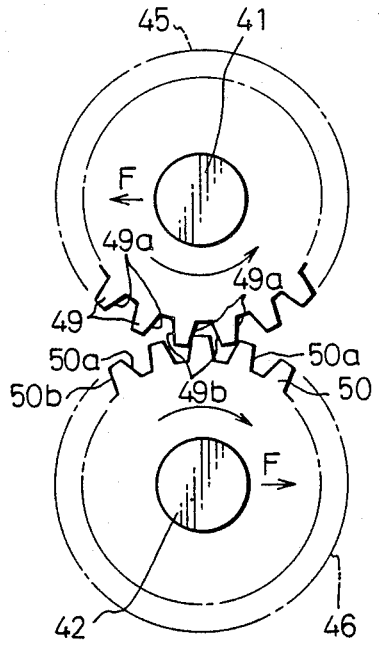
Fig.7 PRIOR ART
FIG. 7 is a cross sectional view of gears taken along the line VII—VII of FIG. 6.

That is, according to the embodiment shown in FIG. 2, the drive-driven relationship between the rotor shafts 3*a* and 3*b* can be easily changed by energizing or de-energizing the coil 34, and therefore the life of the mating gears 4*a* and 4*b* is prolonged because both tooth surfaces (49*a*, 49*b*, 50*a*, 50*b*: FIG. 7) of each tooth of the gears 4*a* and 4*b* are used properly. Further, the loads imposed on the supporting elements such as the ball bearings 26*a* and 26*b*, the oil seals 29*a* and 29*b*, and the bearings 23*a* and 23*b* of the housing 26, can be evenly spread and thus extend the life of the supercharger 20.

Note, in this embodiment, the changes of the drive-driven relationship are preferably made in accordance with the engine driving conditions, which may require the supercharger 20 to be driven at a high speed or a low speed.

In the above embodiment, the multiple-disc clutch 33 is electro-magnetically activated by the coil 34, but the clutch 33 can be hydraulically activated, as an another embodiment, and with regard to the construction of the supercharger 20, the mating gears 4*a* and 4*b* may be arranged in the vicinity of the free-gear 34 and the sub-gear 28, respectively to thereby reduce the size of the supercharger.

In the conventional supercharger not having a speed-up mechanism, if the design of supercharger is directed only to an increase of the volume of air discharged therefrom, i.e., to emphasis the supercharging of the engine, too much air will be discharged from the engine during scavenging, and thus the output of engine will be lowered. The supercharger having the speed-up mechanism as shown in FIG. 2 solves this problem since the volume of air discharged therefrom can be varied as required.

Figure 4:
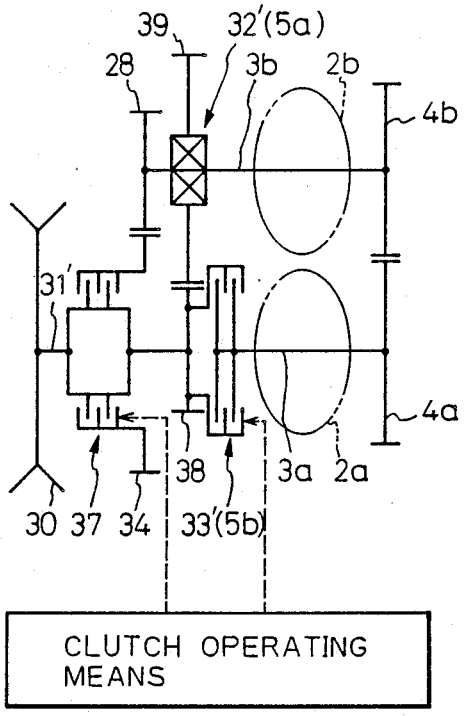
FIG. 4 is a general view of a supercharger in which the speed of rotation of the rotor shafts can be varied in three stages, as a second embodiment of the present invention.
Figure 5:
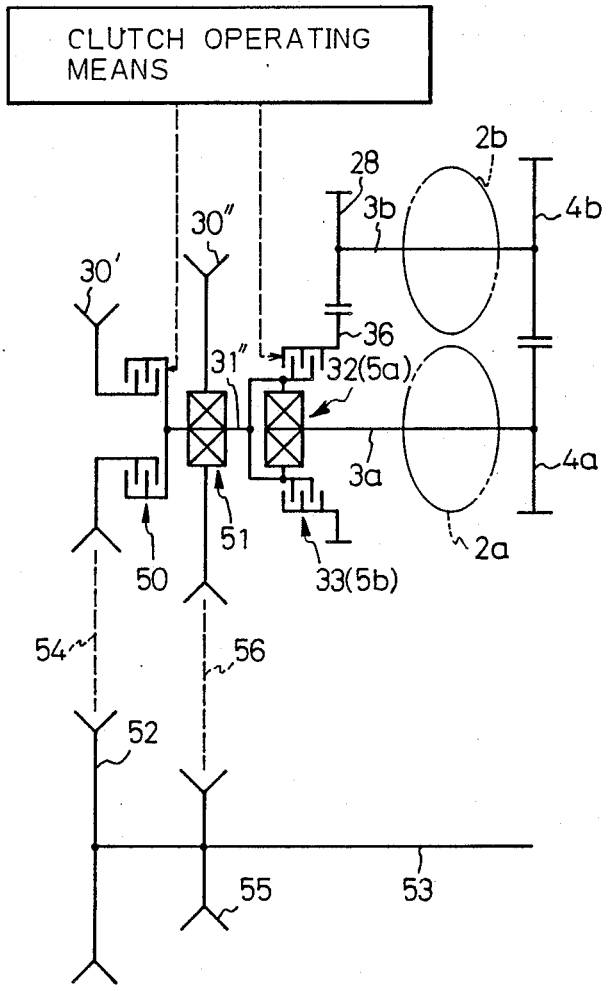
FIG. 5 is a general view of a supercharger in which the speed of rotation of the rotor shafts can be varied in four stages as a third embodiment of the present invention.
Figure 6:
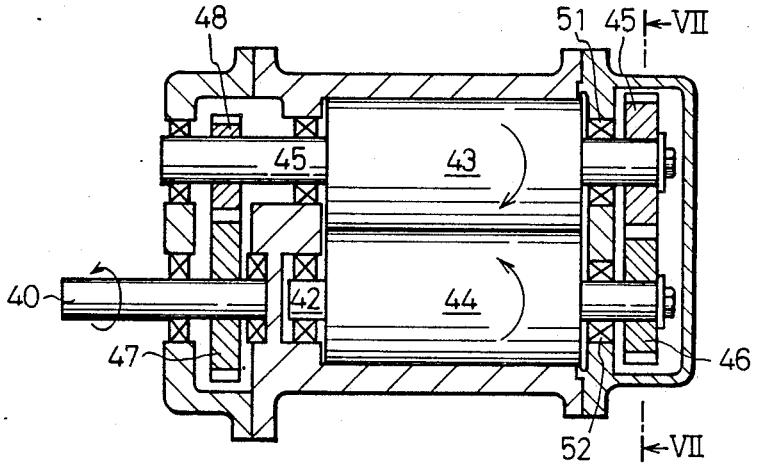
Fig.6 PRIOR ART
FIG. 6 is a sectional view cf a conventional fluid pump.

FIGS. 4 and 5 show superchargers having a prolonged life and wherein the speed of rotation of the rotors can be varied in multistages, i.e., two or more stages, to better cope with the various engine driving conditions.

The constructions and operations of these superchargers are as follows.

Note, in these figures, element similar to those of FIGS. 1 and 2 are indicated by the same reference numerals and elements corresponding to those of FIGS. 1 and 2 are indicated by the same reference numerals suffixed with a prime. As in the previous embodiments, the constructions of these superchargers are illustrated schematically in these figures.

Referring to FIG. 4, a shaft 31, fixed to the pulley 30 is provided with two multiple-disc clutches 33, and 37. The multiple-disc clutch 37 cooperates with the free-gear 34, which is engaged with the sub-gear 28 fixed to the rotor shaft 3*b*.

The other multiple-disc clutch 33′, which corresponds to the second clutch means 5*b* in FIG. 1, connects the pulley shaft 31, with the rotor shaft 3*a* when the clutch 33′ is activated.

The pulley shaft 31, is provided with a small gear 38 which meshes with a large gear 39 arranged coaxially with the rotor shaft 3*b*. The large gear 39 cooperates with the rotor shaft 3*b* through the one-way clutch 32′ corresponding to the first clutch means 5*a* in FIG. 1. Namely, when the large gear 39 is driven in one rotational direction, the one-way clutch 32, transmits the rotation thereof to the rotor shaft 3*b*.

Note, as in the embodiment of FIG. 2, the rotor shafts 3*a* and 3*b* are provided one end thereof, respectively, with the identical mating gears 4*a* and 4*b* which rotate synchronously.

The operation of supercharger shown in FIG. 4 is as follows.

When the speed of rotation of the pulley 30 is reduced while driving the rotors 2*a* and 2*b*, both of the multiple-disc clutches 33' and 37 are inactivated, and as a result, the rotation of the pulley shaft 31' is transmitted to the large gear 39 through the small gear 38, and thus the large gear 39 drives the rotor shaft 3*b* through the intermediary of the operative one-way clutch 32'. The rotation of the rotor shaft 3*b* is finally transmitted to the other rotor shaft 3*a* through the mating gears 4*b* and 4*a*, and consequently, a drive-driven relationship exists between the rotor shafts 3*a* and 3*b* wherein the rotor shaft 3*b* is the drive shaft and the rotor shaft 3*a* is the driven shaft, and at the same time, the one/-way clutch 32' operates as a connecting means for transmitting the drive force of the rotor shaft 3*b*. Note that, in this case the speed of rotation of the pulley 30 is reduced by the gear ratio of the small gear 38 and the large gear 39, and thus rotor shafts 3*a* and 3*b* are rotated at a speed of rotation lower than that of the shaft 31'.

When driving the rotors 2*a* and 2*b* without changing the speed of rotation of the pulley 30, only the multiple-disc clutch 33', which corresponds to the second clutch means 5*b* of the first embodiment, is activated by the clutch operating means to connect the pulley shaft 31, and the rotor shaft 3*a*. Consequently, the rotation of the pulley shaft 31' is transmitted to the rotor shaft 3*a* through the multiple-disc clutch 33' and thus the rotor shafts 3*a* and 3*b* are rotated at the same speed of rotation as that of the pulley shaft 31'. Namely, in this case, a drive-driven relationship exists between the rotor shafts 3*a* and 3*b* wherein the rotor shaft 3*a* is the drive shaft and the rotor shaft 3*b* is the driven shaft. When the above relationship is realized, the one-way clutch 32' is in the inoperative i.e., free-running, condition wherein the speed of rotation of a member (not shown) cooperating with the rotor shaft 3*b* is higher than that of a member (not shown) which is cooperating with the large gear 39, the speed of rotation of which is reduced by the gear ratio of the small gear 38 and the large gear 39.

When the speed of rotation of the pulley 30 is increased while driving the rotors 2*a* and 2*b*, only the multiple-disc clutch 37 is activated by the clutch operating means. Therefore, the rotation of the pulley shaft 31' is transmitted to the free-gear 34 through the operative clutch 37 and accordingly, the speed of rotation of the rotor shaft 3*b* is raised through the sub-gear 28 engaged with the free-gear 34, and finally the rotation of the rotor shaft 3*b* is transmitted to the rotor shaft 3*a* through the mating gears 4*b* and 4*a*. Therefore, during this operation, a drive-driven relationship exists between the rotor shafts 3*a* and 3*b* wherein the former is the driven shaft and the latter is the drive shaft, and the one-way clutch 5*a* is in the inoperative condition.

Namely, the supercharger according to the second embodiment in FIG. 4 is provided with a mechanism by which the speed of rotation of the rotors 2*a* and 2*b* can be varied in three stages, i.e. deceleration, direct connection, and acceleration. Note, preferably these stages are varied in accordance with the engine load; for example, the decelerating stage is used during an engine idling condition, the direct connecting stage is used when going from the idling condition to a medium engine load condition, and the accelerating stage is used during a high engine load condition.

The above-mentioned operations of the clutches 32'(5*a*), 33'(5*b*), and 37, which correspond to each stage are shown in the following table.

TABLE

| | clutch No. | | |
|---|---|---|---|
| stage | 32' (5a) | 33' (5b) | 37 |
| deceleration | transmitting | OFF | OFF |
| direct-connection | free-running | ON | OFF |
| acceleration | free-running | OFF | ON |

FIG. 5 shows a supercharger wherein the speed cf rotation of the rotors can be varied over four stages.

In this embodiment, the rotary drive of the supercharger comprises a pulley shaft 31", a small pulley 30 arranged coaxially with the shaft 31", and a large pulley 30" also arranged coaxially with the shaft 31". A multiple-disc clutch 50 is arranged between the small pulley 30' and the pulley shaft 31", to transmit the rotation of the pulley 30' to the shaft 31" when activated by the clutch operating means. Also a one-way clutch 51 is arranged between the large pulley 30" and the shaft 31", to transmit the rotation of the pulley 30" to the pulley shaft 31" in one rotational direction.

The small pulley 30' is connected to another large pulley 52 fixed to a drive source 53 such as a crankshaft of an engine, through the intermediary of a belt 54, and the large pulley 30" is connected to another small pulley 55 fixed to the drive source 53 through a belt 56.

As in the first embodiment shown in FIG. 2, the multiple-disc clutch 33 is provided for transmitting the rotation of the shaft 31" to the rotor shaft 3*b*, and the one-way clutch 32 is provided for transmitting the rotation of the shaft 31" to the rotor shaft 3*a*. Furthermore, the rotor shaft 3*b* is provided at one end with the sub-gear 28 which meshes with the free-gear 36, and at the other end, with the mating gear 4*b* which meshes with the identical mating gear 4*a* fixed to the rotor shaft 3*a*. Note that, in this embodiment, the one-way clutch 32 corresponds to the first clutch means 5*a*, and the multiple-disc clutch 33 corresponds to the second clutch means 5*b*. As apparent from the foregoing, construction of the supercharger in this embodiment is similar to that of FIG. 2, except for the construction of the rotary drive.

The operation of the above supercharger is as follows. In the engine idling condition, the multiple-disc clutches 33 and 50 are not activated, to reduce the speed of rotation of the rotors 2*a* and 2*b* as much as possible, as a first speed stage, and consequently, the rotation of the small pulley 30' is not transmitted to the shaft 31". Nevertheless, the rotation of the crankshaft 53 is transmitted to the shaft 31" through the intermediary of the small pulley 55, the belt 50, the large pulley 30" and the one-way clutch 51 with a reduction ratio corresponding to a ratio of the diameters of the pulleys 55 and 30". Then, the rotation of the shaft 31" is transmitted to the rotor shaft 3*a* through the intermediary of the one-way clutch 5*a*, and finally, the rotor shaft 3*b* is rotated by the mating gears 4*a* and 4*b*, Namely, in this case, the one-way clutch 5*a* is made operative and a relationship between the rotor shafts 3*a* and 3*b* exists wherein the former is the drive shaft and the latter is the driven shaft.

At a second speed stage selected in the case of a low engine load, the multiple-disc clutch 33 corresponding to the second clutch means 5b of the invention is activated by the clutch operating means, so that the rotation of the crankshaft 53 transmitted to the shaft 31'' through the intermediary of the small pulley 55, the large pulley 30'' and the one-way clutch 51, is transmitted to the rotor shaft 3b through the intermediary of the multiple-disc clutch 33, the free-gear 36, and the sub-gear 28. Therefore, in this case, the speed of rotation of the rotors 2a and 2b is increased in comparison with that at the first speed stage, due to the gear ratio between the free gear 36 and the sub-gear 28. In this second speed stage, the one-way clutch 5a is inoperative and the speed of rotation of element of the rotor shaft 3a is higher than that of the element of the shaft 31'', and thus a relationship between the rotor shafts 3a and 3b exists wherein the former is the driven shaft and the latter is the drive shaft.

At the third speed stage selected in the case of a medium engine load, the multiple-disc clutch 50 is activated by the clutch operating means so that the rotation of the crankshaft 53 is transmitted to the shaft 31'' through the large pulley 52, the belt 54, the small pulley 30', and the clutch 50, by an acceleration ratio corresponding to a ratio of the diameters of the pulleys 52 and 30'. In this case, the one-way clutch 51 is inoperative and the speed of rotation of the element of the shaft 31'', which is raised due to the ratio of the diameters of the pulleys 52 and 30', is higher than that of the element of the pulley 30'', which is reduced due to the ratio of the diameters of the pulleys 55 and 30'', The rotation of the shaft 31'' is transmitted to the rotor shaft 3a through the one-way clutch 32, to thereby rotate the rotor shaft 3b through the mating gears 4a and 4b, and therefore, a relationship between the rotor shafts 3a and 3b exists wherein the former is the drive shaft and the latter is the driven shaft.

At the fourth speed stage selected in the case of a high engine load, both of the multiple-disc clutches 33 and 50 are activated by the clutch operating means, so that the speed of rotation of the shaft 31'' transmitted through the large pulley 52, the belt 54, the small pulley 30', and the multiple-disc clutch 50 is raised by transmission thereof through the multiple-disc clutch 33, the free gear 36, and the small gear 28, to thereby rotate the rotor shafts 3b, and 3a. Therefore, at this stage, a relationship between the rotor shafts 3a and 3b exists wherein the former is the driven shaft and the latter is the drive shaft.

Note that, during this stage, both of the one-way clutches 51 and 32 are inoperative.

The above-mentioned operations of the clutches 32, 33, 50, and 51, corresponding to each of the above stages, are shown in the following table.

TABLE

| | clutch No. | | | |
|---|---|---|---|---|
| stage | 32 (5a) | 33 (5b) | 51 | 50 |
| 1st | transmitting | OFF | transmitting | OFF |
| 2nd | running free | ON | transmitting | OFF |
| 3rd | transmitting | OFF | running free | ON |
| 4th | running free | ON | running free | ON |

As apparent from the foregoing, according to the embodiments shown in FIGS. 4 and 5, non uniform wear of the mating gears 4a and 4b and the elements which support the rotor shafts 3a and 3b can be eliminated by varying the acceleration or deceleration ratio corresponding to the engine driving condition, to thereby change the drive-driven relationship of the rotor shafts 3a, and 3b. Also, it is possible to reduce the noise from the supercharger and to extend the life of the belts 54 and 56 which connect the crankshaft 53 to the pulley shaft 31'', since the supercharger can be operated at a lower speed of rotation than that of the conventional supercharger.

Finally, it will be understood by those skilled in the art that the foregoing description is of preferred embodiments of the disclosed fluid pump, and that various changes and modifications may be made to the present invention without departing from the spirit and scope thereof.

I claim:

1. A fluid pump comprising:

a housing having an inlet and an outlet;

a pair of rotors rotatably arranged in the housing and engaged with each other;

a pair of rotor shafts supporting the rotors, respectively, and rotatably arranged in the housing;

identical mating gears provided on the rotor shafts, respectively, and in mesh with each other;

a rotary drive for driving either of the rotor shafts to rotate the rotors;

a first clutch means provided between the rotary drive and one of the rotor shafts to transmit the rotation of the rotary drive to the rotor shaft;

a second clutch means provided between the rotary drive and the other rotor shaft to transmit the rotation of the rotary drive to the other rotor shaft, when activated;

a clutch operating means which selectively operates one of the first clutch means and the second clutch means to change the drive-driven relationship between one of the rotor shafts and the other of the rotor shafts.

2. A fluid pump as set forth in claim 1, wherein the first clutch means is a one-way clutch which is arranged about one of the rotor shafts, and which is activated to transmit rotation and make the rotor shaft a drive-shaft.

3. A fluid pump as set forth in claim 2, wherein the second clutch means include a multiple-disc clutch which is activated by the clutch operating means, and which is activated to cause the first clutch means to run free and not transmit rotation.

4. A fluid pump as set forth in claim 3 further comprising a large free gear rotatably arranged of the rotor shaft and cooperating with the multiple-disc clutch, a small sub-gear fixed to the other rotor shaft and engaged with the large free gear, wherein when the multiple-disc clutch is activated, rotation of the rotary drive is transmitted to the other rotor shaft through the intermediary of the large free-gear and the small sub-gear, so that the speed of rotation of the rotors is increased due to the gear ratio of the large free-gear and the small sub-gear.

5. A fluid pump as set forth in claim 4, wherein the one-way clutch and the multiple-disc clutch are coaxially arranged about the rotor shaft.

6. A fluid pump as set forth in claim 3, further comprising another multiple-disc clutch activated by the clutch operating means, a large free gear rotatably arranged at the rotor shaft and cooperating with the another multiple-disc clutch, a small subgear fixed to the other rotor shaft and engaged with the large free-gear, another large gear coaxially arranged about the other rotor shaft and cooperating with the other rotor shaft through the intermediary of the one-way clutch, and another small gear connected to the rotary drive and engaged with the another large gear, wherein the multiple-disc clutch is activated to transmit the rotation of the rotary drive to the rotor shaft, and the another multiple-disc clutch is activated to transmit the rotation of the rotary drive to the large free-gear.

7. A fluid pump as set forth in claim 4, wherein the rotary drive comprises a pulley shaft, a small pulley coaxially arranged at the pulley shaft, the small pulley being driven by a crankshaft of an engine, another multiple-disc clutch arranged between the small pulley and the shaft to transmit the rotation of the small pulley to the shaft when activated by the clutch operating means, a large pulley coaxially arranged at the shaft and driven by the crankshaft of an engine, and another one-way clutch arranged between the large pulley and the shaft to transmit the rotation of the large pulley to the shaft when the another multiple-disc clutch is not activated.

8. A fluid pump as set fourth in any one of claim 1 to 7, wherein the fluid pump is a mechanically driven supercharger mounted at an internal combustion engine of a vehicle.

* * * * *

UNITED STATES PATENT AND TRADEMARK OFFICE

CERTIFICATE OF CORRECTION

PATENT NO. : 4,927,333

DATED : May 22, 1990

INVENTOR(S) : Kichiro KATO

It is certified that error appears in the above-identified patent and that said Letters Patent is hereby corrected as shown below:

Column 2, line 31 after "3b" (first Occur.) insert a comma.

Column 2, line 56, change "nave" to --have--.

Column 3, line 2, change "&.he" to --the--.

Column 3, line 27, change "focus" to --forms--.

Column 3, line 51, change "later" to --latter--.

Column 4, line 22, change "as an another" to --as in another--.

Column 4, line 45, change "element" to --elements--.

Column 4, line 52, change "31" to --31' --.

Column 4, line 53, change "33" to --33' --.

Column 4, line 59, change "31" to --31' --.

Column 4, line 61, change "31" to --31' --.

Column 5, line 2, between "provided" and "one" insert --at--.

UNITED STATES PATENT AND TRADEMARK OFFICE

CERTIFICATE OF CORRECTION

PATENT NO. : 4,927,333

DATED : May 22, 1990

INVENTOR(S) : Kichiro KATO

It is certified that error appears in the above-identified patent and that said Letters Patent is hereby corrected as shown below:

Column 5, line 30, change "31" to --31'--.

Column 6, line 19, change "30" to --30'--.

Column 8, line 49, change "of the rotor" to --in the rotor--.

Column 10, line 9, change "claim" to --claims--.

Signed and Sealed this

Twenty-second Day of October, 1991

*Attest:*

*Attesting Officer*

HARRY F. MANBECK, JR.

*Commissioner of Patents and Trademarks*